US005160073A

United States Patent [19]

Bateman

[11] Patent Number: 5,160,073

[45] Date of Patent: Nov. 3, 1992

[54] PACKFRAME WITH DIAGONALLY SUSPENDED PACK

[76] Inventor: James Bateman, Box 809, Jackson, Wyo. 83001

[21] Appl. No.: 686,243

[22] Filed: Apr. 16, 1991

[51] Int. Cl.[5] ..... A45F 3/08

[52] U.S. Cl. ..... 224/210; 224/211

[58] Field of Search ..... 224/210, 211, 212, 213, 224/260, 261, 262, 263, 209, 161, 156, 155

[56] References Cited

U.S. PATENT DOCUMENTS

| | | | |
|---|---|---|---|
| 204,066 | 5/1878 | Merriam . | |
| 362,302 | 5/1887 | Merriam | 224/213 |
| 2,104,486 | 1/1938 | Johansen | 224/211 |
| 2,560,406 | 7/1951 | Bergsland | 224/210 |
| 2,964,222 | 12/1960 | Rainwater | 224/156 |
| 3,347,429 | 10/1967 | Ruth, Jr. . | |
| 3,734,366 | 5/1973 | Wood . | |
| 3,774,824 | 11/1973 | Hansson et al. | 224/161 |
| 4,369,903 | 1/1983 | Wilkes | 224/213 |
| 4,420,103 | 12/1983 | Douglass | 224/210 |
| 4,489,866 | 12/1984 | Korte | 224/211 |

FOREIGN PATENT DOCUMENTS

| | | | |
|---|---|---|---|
| 932882 | 7/1963 | United Kingdom | 224/212 |

OTHER PUBLICATIONS

Six Pack advertisement No. P0907, 64-65 Winter Edition of Mountain Climbing and Clamping Equipment.

"Guide Frame-The Fit" article, Dana Design.

*Primary Examiner*—Linda J. Sholl

*Attorney, Agent, or Firm*—Andrew D. Maslow

[57] ABSTRACT

A backpack provided with a pack frame and pack bag for transferring a substantial portion of the loading being carried to the wearer's hips. The pack bag is suspended from the pack frame and maintained in a position diagonal to the plane of the pack frame. The point of suspension of the pack bag to the pack frame is at a point higher than the point of attachment of the shoulder straps to an upper portion of the pack bag.

5 Claims, 2 Drawing Sheets

PACKFRAME WITH DIAGONALLY SUSPENDED PACK

BACKGROUND OF THE INVENTION

1. Field of the Invention

This invention relates to frames used to support a pack for carrying a load of material on the wearer's back. In particular, the invention relates to a maneuverable well balanced packframe for carrying heavy loads and is useful for backpacking, back country skiing and camping.

2. Description of the Prior Art

There are many known designs for external pack frames for supporting a pack bag and which comprise two vertical supports connected by transverse supports. In most of these pack frames the bag is positioned so that when carried it rests directly on the frame supports and the frame is attached to the wearer. Although these packframes have hip straps, a good deal of weight is supported by the shoulder straps. When the wearer leans forward, as is necessary in walking or skiing, the weight of the pack is taken off the hips and placed more upon the shoulders and lower back. This makes the pack difficult to carry and puts an extra burden on the wearer's back. The pack bag attached to the standard external frame also tends to flop around during vigorous activity, such as skiing or climbing.

U.S. Pat. No. 4,489,866 to Korte shows a rectangular packframe and pack bag. The bag is supported by the frame. The shoulder straps are attached directly to the frame. A vertical line drawn through the center of the pack bag is substantially parallel to the plane of the rectangular frame supporting structure. Once place upon the wearer's back, a substantial amount of the weight of the pack bag is placed upon the shoulder straps. This problem is typical of the disadvantages of conventional packframes and pack bags.

In U.S. Pat. No. 4,369,903 to Wilkes a packframe is shown which attempts to shift more of the weight of the load to the wearer's hips, thereby alleviating the load being supported by the shoulder straps. However, this packframe still has some of the same disadvantages of the prior art. The shoulder straps remain attached to the frame. Presumably the pack bag is mounted on the frame and the transfer of weight is accomplished with cross linkage bars extending from a crossbar on the upper portion of the frame to the hip straps. This patent does not teach nor suggest to suspend the pack bag from the frame so as to maintain the pack bag in a plane substantially diagonal to the plane of the frame.

In U.S. Pat. No. 3,734,366 to Wood the inventor is concerned with maintaining the pack bag away from the wearer's back. This is accomplished by the use of bowed flexible rods. However, since the shoulder straps remain attached to the frame, there is not a substantial shifting of the weight load to the hips nor is there a lessening of the weight supported by the shoulder straps.

In U.S. Pat. No. 204,066 to Merriam a knapsack is shown. This early knapsack is not supported by a packframe and the weight of the load is carried completely on the wearer's shoulders. More modern backpacks are shown in U.S. Pat. No. 4,420,103 to Douglas and 3,347,429 to Ruth. Neither of these patents teach the use of a packframe from which a pack bag is suspended diagonally in order to transfer more weight to the hips.

SUMMARY OF THE INVENTION

The present invention provides a packframe and pack bag which includes a structure for transferring a substantial portion of the load being carried to the wearer's hips. To accomplish this the pack bag is raised and suspended from the packframe and maintained in a position diagonal to the plane of the packframe. The vertical plane of the pack bag intersects the plane of the packframe within the outer boundaries of the packframe. Shoulder straps are provided which are attached to the upper one half of the pack bag at one end, and to the lower portion of the packframe at the other end.

It is an object of the invention to provide a pack bag and frame that allows more weight to be supported by the wearer's hips.

It is a further object of the invention to provide a pack bag and frame wherein the shoulder straps carry little weight and serve primarily to balance the load.

It is a still further object of the invention to provide a pack bag and frame that allows the wearer to balance the load on the wearer's hip permitting the wearer to comfortably stand or walk more upright than in previous designs.

Yet another object of the invention is to provide a pack bag and frame for carrying heavy loads.

Another object of the invention is to provide a pack bag and frame where the bag is supported closer to the vertical plane passing through the wearer's hips and while still allowing the wearer to go through a full range of forward and backward leaning positions.

The invention accordingly comprises the features of construction, combination of elements, and arrangement of parts which will be exemplified in the construction hereinafter set forth, and the scope of the invention will be indicated in the claims.

DETAILED DESCRIPTION OF THE INVENTION

Figure 1:
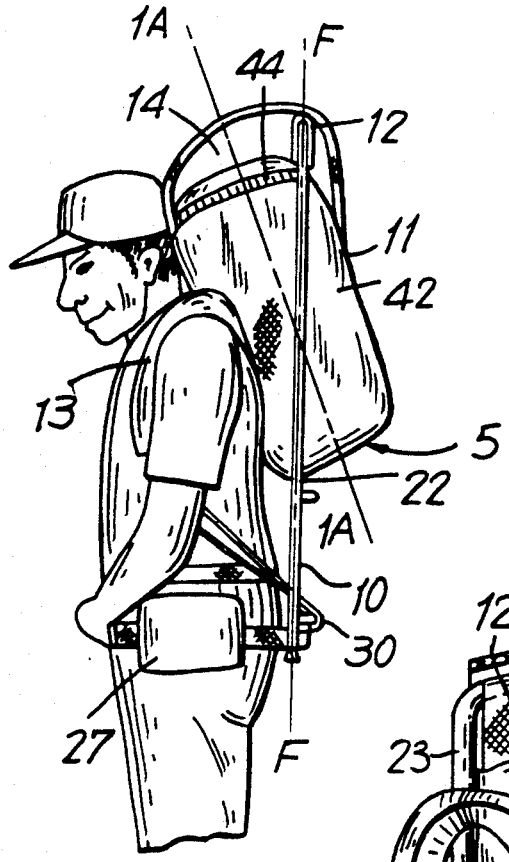
In FIG. 1 a side perspective view is shown in which the wearer of the pack is standing in a upright position.
Figure 2:
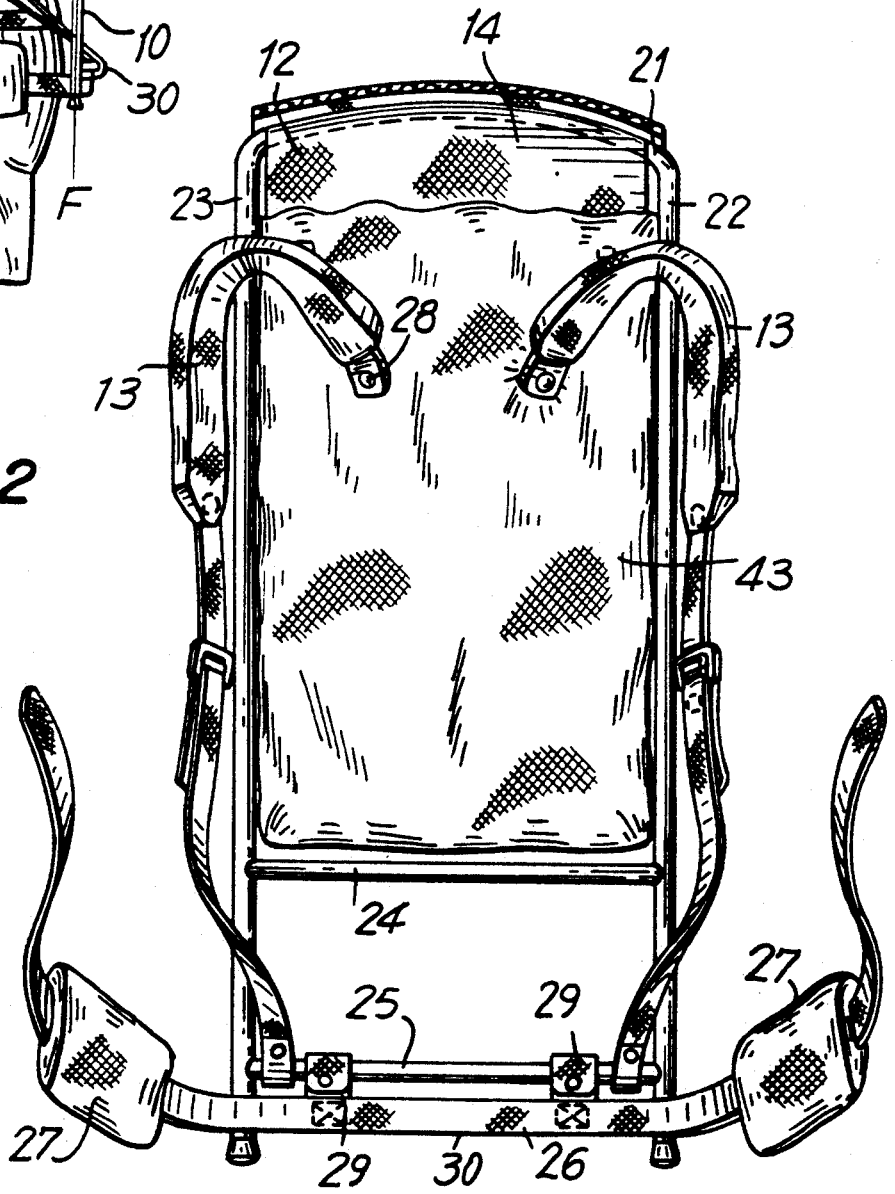
FIG. 2 is a front perspective view of the packframe and pack bag.
Figure 4:
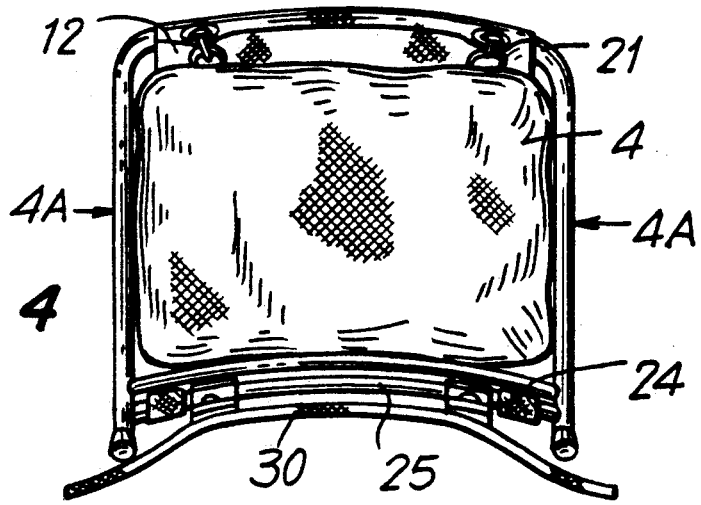
FIG. 4 is a bottom view taken along line 4—4 and showing the packframe and pack bag of the invention.

Referring initially to FIGS. 1 and 2, a packframe 10 is shown with pack bag 11 suspended from the upper transverse or horizontal member 21. Pack bag 11 has a top 44, left and right sides 42, back 43 and bottom 44 shown in FIG. 4. In the preferred embodiment left vertical support 22 is bent about 90 degrees to form upper transverse support 22 which in turn is bent downward about 90 degrees to form right vertical support 23. Middle transverse support 24 and bottom traverse support 25 connect left and right vertical supports and are attached by any conventional means such as welding, fasteners or nuts and bolts. The pack bag 11 is fastened to the frame by hinge strap 12 which is sewn or otherwise fastened to upper corner of the back of the pack bag and then wrapped around upper transverse support 21 and then reattached to the bag in the vicinity of the first attachment. This method of attachment allows the bag to be hinged to and supported by the frame in a diagonal position as can be seen in FIG. 1. It can be seen that by this means of attachment, when the wearer of the pack leans forward, the weight of the bag tends to remain well over the hips of the wearer and the top of the bag is held above the wearer's neck. This allows the wearer to carry heavy loads while engaging in vigorous activities such as skiing or climbing without undue strain on the lower back and shoulders.

Figure 3:
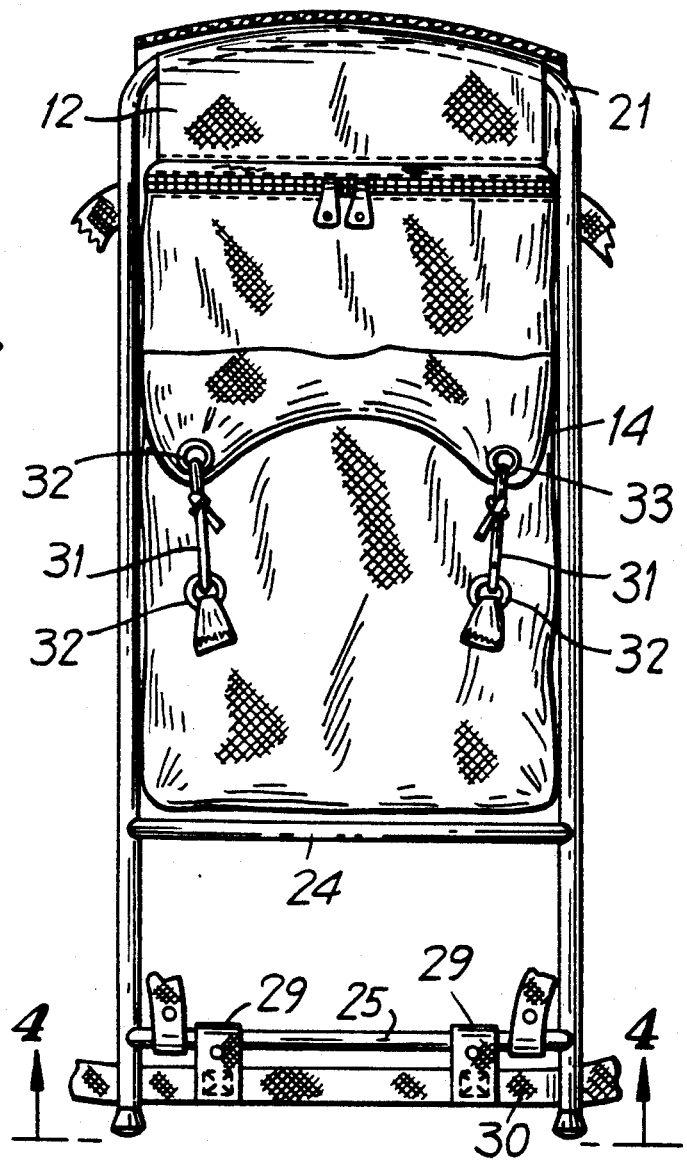
FIG. 3 is a back view of the packframe and pack bag of the invention.

As shown in FIG. 2, shoulder straps 13 are attached directly to the bag by rivets at joints 28 located on the upper ⅓ of the bag. The bottom of the shoulder straps can be attached to hip strap 30 or to the bottom transverse member 25. Hip strap 30 is attached to bottom transverse member 25 by hinges 29 which are sewn to the hip strap and wrapped around transverse member 25 and resown to the hip strap. Hip strap 30 is provided with hip pads 27 for extra protection of the hips. It can be seen that since the shoulder straps 13 are directly attached to the pack bag instead of the pack frame, the bag will remain more secure and is less likely to flop around during extreme physical activity of the wearer. In FIG. 3 it is shown that the bag is provided with a top flap 14 which can be extended over the hinge strap 12 and tied down to the back of the bag by attaching ropes 31 to loops 32 and also through holes 33.

It can be seen that the vertical and transverse supports generally define a plane of the external packframe. Said plane is shown in FIG. 1 at line F—F as being substantially parallel to the body of the wearer. The general plane of the pack bag 11 is that which is defined by lines 4A—4A passing through the center of the sides of the bag and 1A—1A passing through the approximate center of the top and bottom of the bag. It can thus be seen in FIG. 1 that the plane of the bag intersects the substantially vertical plane of the packframe within the boundaries of the frame. It is possible, although not shown, to attach the sides of the bag to the vertical supports 22 and 23 by loops loosely wrapped around the vertical members and sewn to the sides of the bag to insure that the bag remains in this general position.

It will thus be seen that the objects set forth above, among those made apparent from the preceding description, are efficiently attained and, since certain changes may be made in carrying out the above packframe and pack bag without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which as a matter of language might be said to fall therebetween.

What is claimed is:

1. A backpack comprising:

a pack bag having shoulder straps attached to an upper portion of the pack bag forming a first point of attachment, a top, bottom, front, back, left and right sides;

a substantially rectangular frame formed in a single plane for supporting said pack bag;

said frame comprising at least two substantially vertical parallel members wherein said members define the single plane and boundaries so that when the backpack is carried by the shoulder straps being placed over the shoulders of the wearer, said single plane of the frame is substantially parallel to the body of the wearer;

suspension means for suspending said pack bag from the frame with point of attachments of said suspension means on the pack bag and the frame being at a height higher than said first point of attachment with the backpack positioned on the wearer; and said suspension means provided such that the plane of the pack bag defined by (a) a first line going through the approximate center of the top of said bag and the approximate center of the bottom of the bag, and (b) a second line passing through the approximate center of the left side of the bag and the approximate center of the right side of the bag, intersects the single plane of the frame within the boundaries of the frame.

2. The backpack of claim 1 wherein the frame comprises two vertical members connected by at least one horizontal member.

3. The backpack of claim 2 wherein said pack bag is suspended from the horizontal member of the frame.

4. The backpack of claim 3 wherein said suspension means suspends the pack bag at a height above the head of the wearer.

5. The backpack of claim 4 wherein the shoulder straps are attached to the upper portion of the pack bag at one end of each strap and to the lower portion of the frame at the other end of each strap.

* * * * *